US007530641B2

(12) United States Patent
Berning et al.

(10) Patent No.: US 7,530,641 B2
(45) Date of Patent: May 12, 2009

(54) AUTOMOTIVE CONSTRUCTION MACHINE, AS WELL AS METHOD FOR WORKING GROUND SURFACES

(75) Inventors: Christian Berning, Zuelpich (DE); Herbert Lange, Overath (DE); Dieter Simons, Buchholz (DE)

(73) Assignee: Wirtgen GmbH, Windhagen (DE)

( * ) Notice: Subject to any disclaimer, the term of this patent is extended or adjusted under 35 U.S.C. 154(b) by 162 days.

(21) Appl. No.: 11/802,277

(22) Filed: May 22, 2007

(65) Prior Publication Data

US 2007/0286678 A1 Dec. 13, 2007

(30) Foreign Application Priority Data

May 22, 2006 (DE) ..... 10 2006 024 123

(51) Int. Cl.
*E01C 23/088* (2006.01)

(52) U.S. Cl. ..... 299/1.5; 404/84.05

(58) Field of Classification Search ..... 299/1.05, 299/1.4, 1.5; 404/84.05
See application file for complete search history.

(56) References Cited

U.S. PATENT DOCUMENTS 4,139,318 A 2/1979 Jakob et al.
4,929,121 A * 5/1990 Lent et al. ..... 299/1.5
4,943,119 A * 7/1990 Zarniko et al. ..... 299/1.5
5,607,205 A * 3/1997 Burdick et al. ..... 299/1.5
5,984,420 A * 11/1999 Murray et al. ..... 299/1.5
6,050,743 A 4/2000 Medinger
6,152,648 A * 11/2000 Gfroerer et al. ..... 299/1.5

FOREIGN PATENT DOCUMENTS

DE 30 07 124 A1 9/1981
EP 1 408 158 A1 10/2003
WO WO 97/20109 6/1997

* cited by examiner

*Primary Examiner*—John Kreck
(74) *Attorney, Agent, or Firm*—Miles & Stockbridge P.C.; Vincent L. Ramik, Esq.

(57) ABSTRACT

An automotive construction machine for working ground surfaces, with a machine frame, a drive engine for driving traveling devices and for driving working devices, and a milling drum for milling the ground surfaces, which can be raised, driven by, and can be uncoupled from a drum drive, the milling drum can be moved into a raised position when not in milling mode, and when raised, the rotating direction of the milling drum corresponds to the rotating direction of the traveling devices and remains coupled with the drive engine, and a monitoring device monitors the distance between the milling drum and the ground surface and uncouples the raised milling drum from the drive engine or uncouples the traveling devices from the drive engine or raises the machine frame or generates an alarm signal when the monitoring device detects a deviation that falls below a pre-determined distance, or any of the latter.

20 Claims, 4 Drawing Sheets

AUTOMOTIVE CONSTRUCTION MACHINE, AS WELL AS METHOD FOR WORKING GROUND SURFACES

BACKGROUND OF THE INVENTION

The invention concerns an automotive construction machine, as well as a method for working ground surfaces.

Such automotive construction machines for working ground surfaces are known, for instance, from EP 1408158 A.

The road milling machine described therein shows a machine frame with a drive engine for driving traveling devices and for driving working devices. The traveling devices may consist of either wheels or crawler tracks, which are connected to the machine frame via lifting columns.

A drum drive drives a milling drum for milling the ground surfaces preferably in up-milling mode. The milling drum is capable of being uncoupled from the drive train by means of a coupling. A scraper blade is located in a height-adjustable manner behind the milling drum when seen in the direction of travel, which can glide on the surface milled or to be milled by the milling drum. In milling mode, the lower edge of the scraper blade is always located at the lowest plane of the cutting circle of the milling drum.

Such construction machines operate in strips in accordance with the width of the milling drum. This means that the construction machine has to travel back after having milled a pre-determined length of ground surface in order to then mill an adjacent strip.

It is necessary that the milling drum is idle when traveling backwards in order to avoid any accidental collision of the tools of the milling drum with the ground surface, because the construction machine may be accelerated suddenly and uncontrollably in case of an inadvertent engagement of the milling drum with the ground surface. The circumferential speed of the milling drum, in particular at operating speed, is many times, for instance, three times that of the travel speed so that the road construction machine may be accelerated forcefully in case of an engagement of the milling drum.

This results in a risk of the milling drum being damaged in case of an accidental engagement with the ground surface, so that the milling drum is first uncoupled from the drive train after it has been raised from the milled cut at the end of a ground surface to be worked. The construction machine can now be driven back to the beginning of the length of ground to be worked, where the speed of the drive engine must be reduced to idle speed first to enable coupling of the milling drum.

Contrary to the engine of a passenger car, a considerable waiting period elapses until the speed of the drive engine, which consists of a combustion engine, has been reduced to idle speed and also until it has been increased to operating speed again.

The combustion engine must then be brought back to operating speed prior to working the next strip. These processes are very time-consuming and very annoying for the machine operator, in particular in case of short stretches of road to be worked. Moreover, the incessant switching operations of the coupling and the related frequent load changes of the combustion engine give rise to increased wear and tear of the coupling, the combustion engine and all components that are part of the drive train.

The purpose of the invention is, therefore, to create a construction machine, as well as a method for working ground surfaces, which is capable of reducing the time required for working a pre-determined ground space.

The invention provides in an advantageous manner that the milling drum, when in raised position and with a direction of travel in which the rotating direction of the milling drum corresponds to the rotating direction of the traveling devices, remains coupled with the drum drive and that a monitoring device monitors a distance between the milling drum and the ground surface and uncouples the raised milling drum from the drive engine and/or uncouples the traveling devices from the drive engine and/or raises the machine frame and/or generates an alarm signal when the monitoring device detects a deviation which falls below a pre-determined distance.

According to the invention, the milling drum can remain coupled with the drive engine in a permanent manner.

It is no longer required to uncouple the milling drum from the drive train when it is raised out of the milled cut. As a result, it is also not necessary to reduce and subsequently increase the speed of the combustion engine in order to engage the milling drum again after repositioning. The milling drum can be removed from the milled cut by swivelling or raising it, for instance, via lifting columns of the traveling devices. When the milling drum is in the raised position, a monitoring device detects as to whether the distance between the raised milling drum and the ground surface, which has been pre-determined for traveling when not in milling mode, is maintained. If the deviation falls below the pre-determined distance, the raised milling drum, which at that time continues rotating, is uncoupled from the drive engine so that, should the milling drum actually come into contact with the ground, the drive power has no effect on the milling drum and only the milling drum's actual kinetic energy of rotation has to be destroyed. When doing so, the mass of the construction machine suffices to prevent the construction machine from carrying out a jump in the direction of travel in case the milling drum inadvertently engages with the ground surface. In this way, it is ensured that no time loss is incurred due to the fact that a reduction and increase of the speed of the drive engine have to be waited for when the construction machine is traveling without being in milling mode.

A further advantage is that the wear and tear of machine elements, in particular of the coupling, the combustion engine and all other components that are part of the drive train, is reduced.

It is preferably provided that the milling drum mills the ground surface in up-milling mode, in which case traveling in forward direction is uncritical as the milling drum rotates in opposition to the direction of travel. The invention concerns itself with traveling in backward direction, in which the milling drum can, contrary to prior art, remain coupled with the drive engine despite the milling drum rotating in opposition to the direction of travel.

Likewise, traveling backwards when the milling drum is in down-milling mode is uncritical due to the milling drum rotating in the direction of travel, and according to the invention, the milling drum, when in raised position, remains coupled with the drive engine also when traveling in forward direction without being in milling mode.

Monitoring of the pre-determined distance by the monitoring device can be effected either directly or indirectly. Direct measuring is effected, for instance, by means of mechanical or electronic measurement of the distance, whereas indirect measuring of the distance can be effected, for instance, via machine elements of the construction machine, via tracers or via the actual position of the lifting column carrying the machine frame.

When doing so, the pre-determined distance between the raised milling drum and the ground surface can be monitored with at least one sensor.

The pre-determined distance to be monitored by the monitoring device may be capable of being increased in accordance with the travel speed of the traveling device. The pre-determined distance can, for instance, be increased proportionally or progressively in accordance with the increasing travel speed.

A preferred embodiment of the invention provides that the milling drum is raised by a pre-determined amount that is larger than a minimum distance to be maintained between the milling drum and the ground surface, and that a sensing device measuring towards the ground surface shows a lower limit position which corresponds to a pre-determined distance or to a minimum distance to be maintained between the milling drum and the ground surface. With such a sensing device, the monitoring device has to merely establish as to whether the sensing device leaves the lower limit position, because in this case a pre-determined distance or a minimum distance to be maintained by the milling drum is no longer adhered to.

The construction machine may be provided with a sensing device that is capable of being lowered relative to the milling drum, the said sensing device projecting vis-à-vis the milling drum towards the ground surface by a pre-determined distance in relation to the lowest point of the cutting circle of the milling drum. With the milling drum in raised position and the sensing device simultaneously in lowered position, the monitoring device generates, for instance, a control signal for uncoupling the milling drum from the drive engine if the at least one sensor detects a contact of the at least one sensing device with the ground surface or that the at least one sensing device is raised by the ground surface. This means that the sensing device, which may in the most simple case consist of a tracer, is simultaneously lowered to a lower limit position while the milling drum is raised, the said lower limit position corresponding to a pre-determined distance or to a minimum distance between the rotating milling drum and the ground surface. When doing so, the sensing device itself maintains a distance vis-à-vis the ground surface. If the sensing device touches the ground surface while the construction machine travels without being in milling mode, or if it is detected that the sensing device is raised by the ground surface, then the monitoring device generates, for instance, a control signal for uncoupling the milling drum from the drum drive or the drive train respectively.

The sensor is capable of detecting a ground contact, for instance, by means of a structure-borne sound sensor, or the position of the sensing device, for instance, by means of a path sensor. As an alternative, the lowest position of the sensing device can be determined by means of a limit switch.

Apart from uncoupling the milling drum, the monitoring device can additionally or alternatively uncouple the traveling devices from the drive engine and/or raise the machine frame and/or set off an alarm signal.

In the raised position of the milling drum, the sensing device is lowered towards the ground surface by a pre-determined amount that is larger than the pre-determined distance between the milling drum and the ground surface. The sensor is capable of at least detecting the lower limit position of the sensing device, with the lower limit position corresponding to, for instance, the minimum distance between the milling drum and the ground surface.

The sensing device may consist of a scraper blade that is arranged behind the milling drum when seen in the direction of travel. The scraper blade is capable of being lowered downwards beyond the lowest position of the cutting circle of the milling drum.

A further alternative provides that the sensing device consists of a hood enclosing the milling drum and/or of a side plate that is arranged at the side next to a front end of the milling drum.

As described previously in connection with the sensing device, the scraper blade, the hood, or the side plates provided for at the front ends of the milling drum can also be lowered beyond the lowest point of the cutting circle of the milling drum in the same way. The position of the side plates, of the scraper blade and of the hood enclosing the milling drum can be monitored with regard to their distance from the ground surface in the same way as previously described in connection with the sensing device.

In case of a hood enclosing the milling drum, the said hood can be lowered relative to the milling drum. Such hood is known, for instance, from WO 97/20109.

In the following, embodiments of the invention are explained in more detail with reference to the drawing.

DESCRIPTION OF THE PREFERRED EMBODIMENTS

Figure 1:
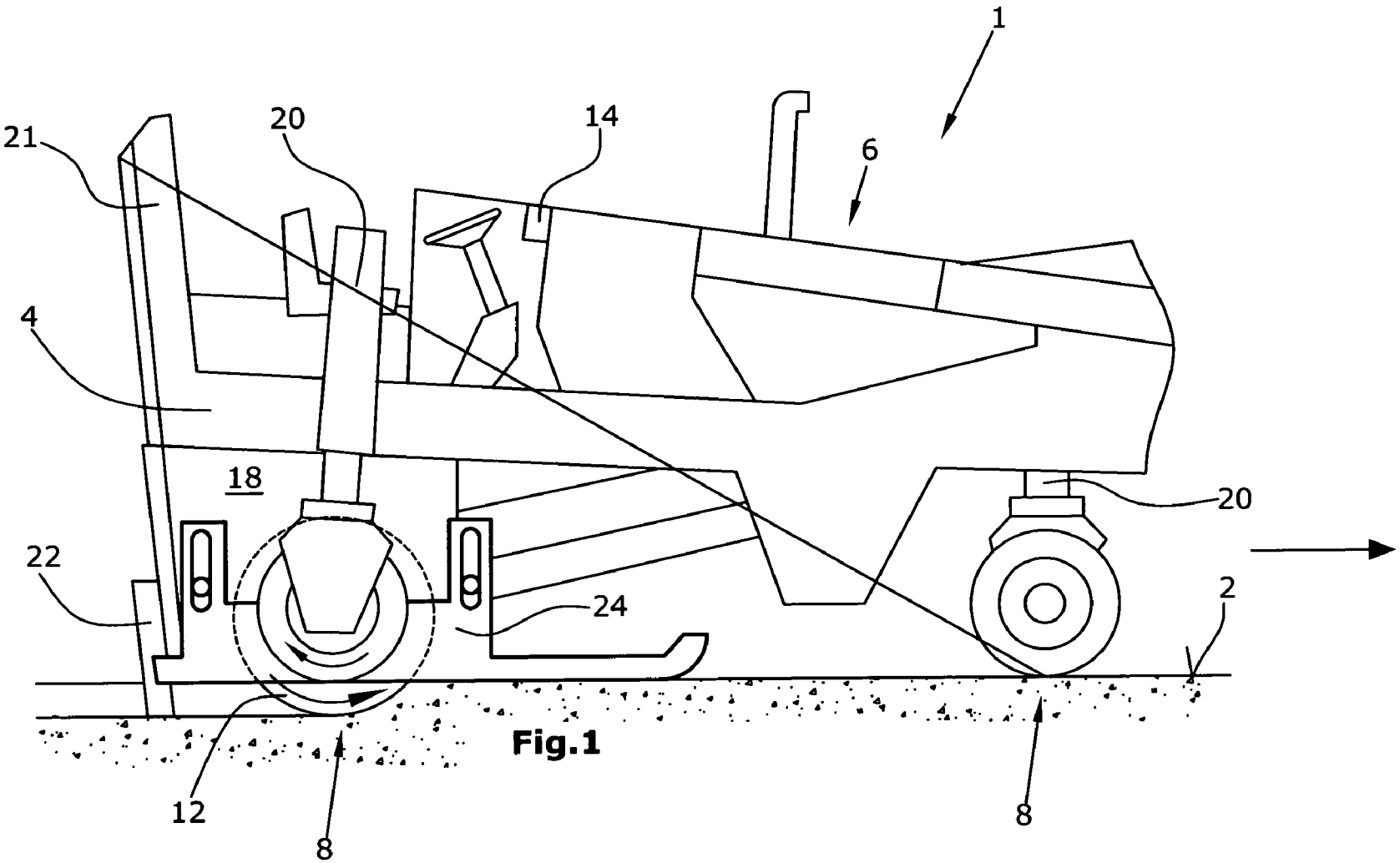
FIG. 1 is an automotive road milling machine for working ground surfaces in working mode.

The automotive construction machine 1 for working ground surfaces 2 shown in FIG. 1 shows a machine frame 4, as well as a drive engine 6 for driving traveling devices 8 and for driving working devices. In the embodiment in FIG. 1, the traveling devices 8 consist of wheels, whereas in the embodiment in FIG. 3, the said traveling devices 8 consist of crawler track units. The main working device consists of a milling drum 12 for milling the ground surface 2, where the said milling drum 12 is capable of being driven by a drum drive 10 and of being uncoupled from the drive engine 6.

The milling drum is capable of being moved into a raised position when it is not in milling mode.

The raised position of the milling drum 12 is preferably achieved by means of the lifting columns 20, by way of raising the machine frame 4 altogether. In doing so, the milling drum 12, which is supported in the machine frame 4, is raised out of the milled track until it shows a pre-determined distance from the ground surface 2. While the milling drum 12 is raised out of the milled track and during the subsequent travel, the milling drum 12 remains coupled with the drive engine 6 via the drum drive 10 and a coupling 7 so that it is not necessary to first reduce the speed of the drive engine 6, preferably a combustion engine, to idle speed, then uncouple the milling drum 12 from the drive engine 6 and subsequently increase the speed of the drive engine 6 once again to its operating speed.

Figure 2:
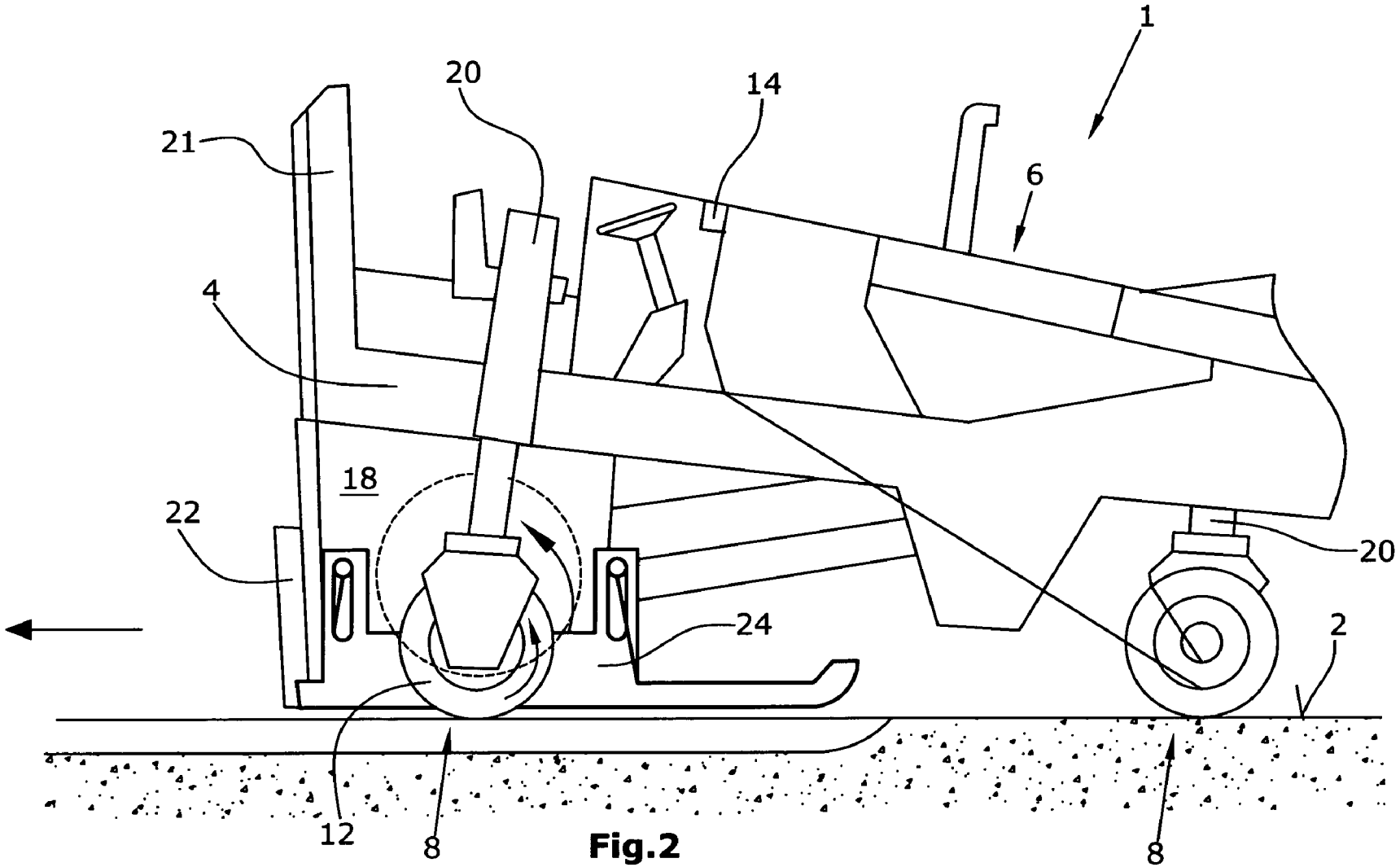
FIG. 2 the road milling machine in accordance with FIG. 1 traveling in backward direction.

FIG. 1 shows the milling drum 12 in up-milling mode, in which the rotating direction of the milling drum 12 is in opposition to the rotating direction of the traveling devices 8. When traveling backwards, as is shown in FIG. 2, the rotating direction of the milling drum 12 corresponds to the rotating direction of the traveling devices 8 so that there is the risk of the construction machine 1 being accelerated in an undesired manner in case of accidental contact with the ground surface 2. A monitoring device 14 has therefore been provided which monitors the distance between the milling drum 12 and the ground surface 2 and uncouples the raised milling drum 12 from the drum drive 10 when the monitoring device 14 detects a deviation that falls below a pre-determined distance. It may alternatively or additionally be provided that the traveling devices 8 are uncoupled from the drive engine 6, or that the machine frame is raised, or that an alarm signal is generated.

The distance between the milling drum 12 and the ground surface 2 can be measured either directly or indirectly. The detection signals of the monitoring device 14 can either be forwarded to a machine control system, or can be used directly for uncoupling the milling drum 12 or the traveling devices 8 from the drive engine 6, or can alternatively or additionally be used for raising the machine frame 4 by means of the lifting columns 20 or for generating an alarm signal.

A sensor is preferably provided for monitoring the distance between the milling drum 12 and the ground surface 2. This sensor can measure the distance to the ground surface 2 either directly or indirectly. The position of a sensing device is monitored, for instance, in case of indirect measuring, where the said monitoring is effected, for instance, by means of a path measuring device or by means of a limit switch that detects a certain position of the sensing device.

The distance to be monitored may either be a pre-determined fixed distance, or may consist of a pre-determined fixed minimum distance, or can be variable in that it is capable of being increased in accordance with an increasing travel speed of the traveling devices 8. This means that the pre-determined distance increases continually and preferably in a proportional manner in accordance with the increasing travel speed.

A sensing device capable of being lowered relative to the raised milling drum 12 may be arranged at the machine frame 4 in such a manner that the sensing device projects vis-à-vis the milling drum 12 towards the ground surface 2 by a pre-determined distance, with the monitoring device 14, in the raised position of the milling drum 12 and the simultaneously lowered position of the sensing device, uncoupling at least the milling drum 12 from the drive engine 6 when the monitoring device 14 detects a contact of the at least one sensing device with the ground surface 2 or that the at least one sensing device is raised by the ground surface 2. It is understood that, apart from uncoupling the milling drum 12 from the drive engine 6, the traveling devices 8 may alternatively or additionally also be uncoupled from the drive engine 6 or the machine frame 4 be raised via the lifting columns 20.

A preferred embodiment in accordance with FIGS. 1 and 2 provides that the sensing device consists of a scraper blade 22 that is arranged behind the milling drum 12 when seen in the direction of travel.

When in milling mode in accordance with FIG. 1, the scraper blade 22, which is essentially height-adjustable vertically within a portal 21, is located in the milled track and scrapes the newly milled track behind the milling drum 12 to ensure that no remains are left behind in the milled track.

The lower edge of the scraper blade 22 is then located in the same plane as the lowest point of the cutting circle of the milling drum 12 shown in the drawings.

FIG. 2 shows the milling drum 12 in the raised position, in which the lowest point of the cutting circle shows a distance from the ground surface 2. The scraper blade 22 is also in a raised position outside of the milled track, with the lower edge of the scraper blade 22 showing a significantly smaller distance from the ground surface 2 than the milling drum 12. The distance of the lower edge of the scraper blade 22 may correspond to a pre-determined distance that the milling drum 12 has to maintain from the ground surface 2.

The monitoring device 14 is capable of determining, for instance, as to whether the scraper blade 22 touches the ground surface 2 by using, for instance, a structure-borne sound sensor.

Alternatively, the monitoring device 14 is capable of determining, for instance, as to whether the scraper blade 22 is raised by the ground surface 2, thus leaving its lower limit position. In the simplest case, this can be determined by means of limit switches for the lowest position of the scraper blade 22.

It is understood that a distance sensor can also be arranged at the scraper blade 22, which is capable of measuring the distance to the ground surface 2 directly in a non-contact manner.

It is further understood that in lieu of the scraper blade 22, a tracer can, for instance, be used that is preferably spring-loaded and projects from the machine frame 4.

In a further alternative, the side plate 24, which is preferably arranged at the front ends on both sides of the milling drum 12, may also be used as a sensing device. FIG. 1 shows the side plate 24 in operating mode, in which the side plate 24 rests on the ground surface 2 and prevents the milling edge from breaking. For that reason, such a side plate 24 is frequently also called an edge protection. As can be seen from the drawings, the side plate 24 is height-adjustable vertically, and it always rests on the ground surface 2 irrespective of the current milling depth of the milling drum 12.

It can be seen in FIG. 2 that, in the raised position of the milling drum 12, the side plate 24 is also raised until it shows a pre-determined distance from the ground surface 2. It can be seen in FIG. 2 that the side plate 24 has reached the lower limit position in a vertical guide. Detection of the distance or of a minimum distance is effected in the same way as with the height-adjustable scraper blade 22.

Figure 3:
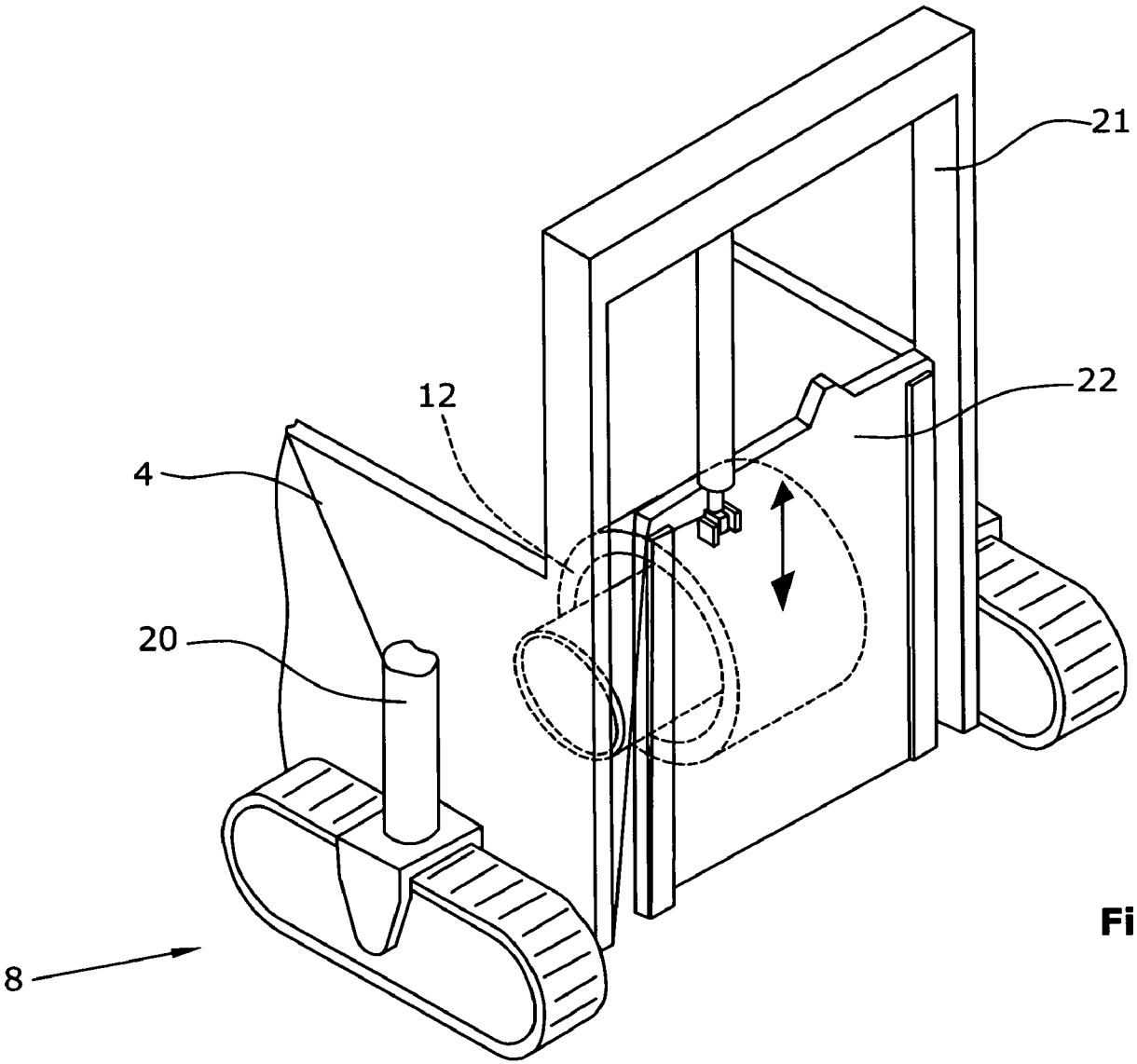
FIG. 3 a view of the height-adjustable scraper blade.

FIG. 3 shows an embodiment of a scraper blade 22 as it is basically already known from EP 1 408 158 A.

Figure 4:
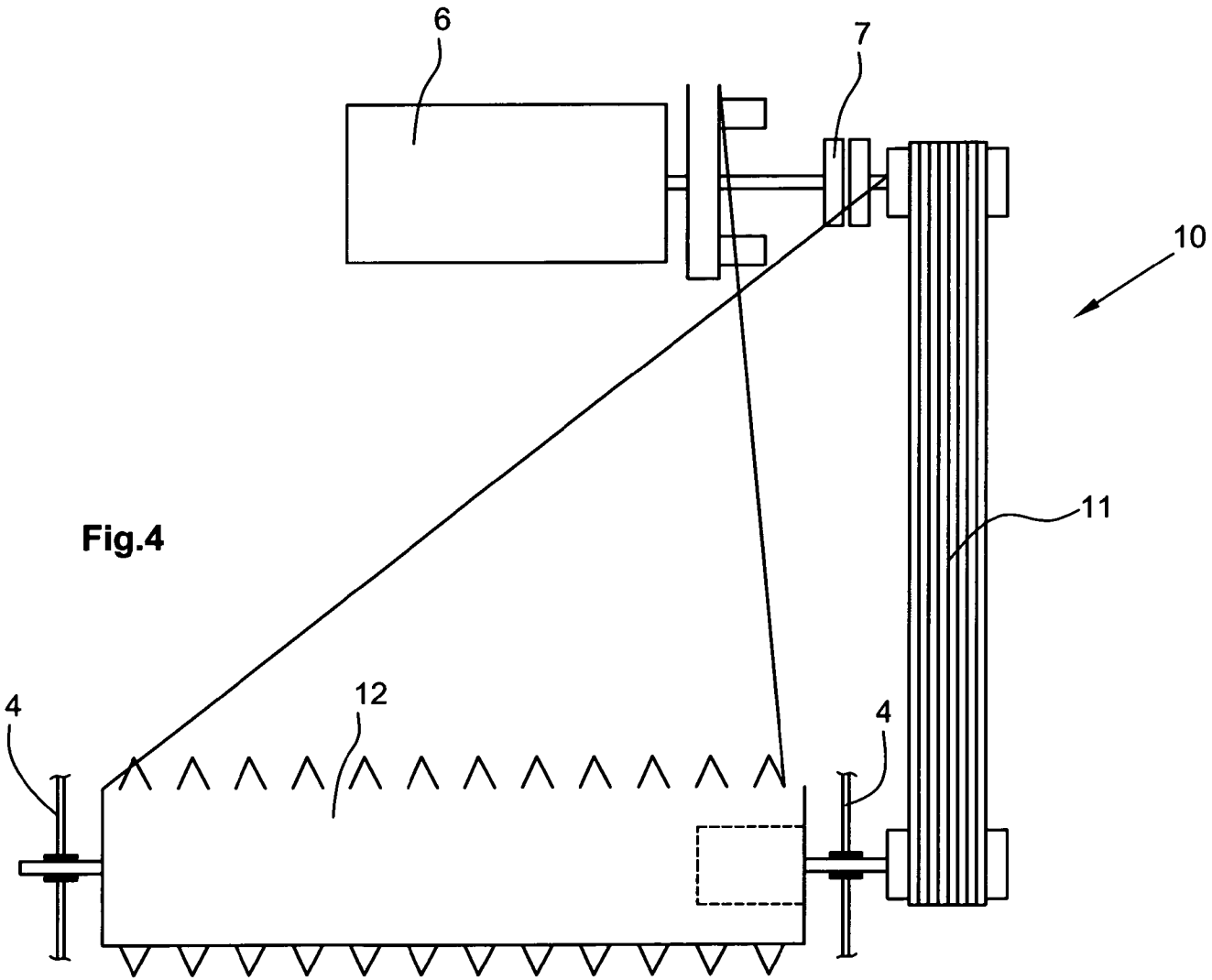
FIG. 4 a drive train with drum drive.

FIG. 4 shows the drive train of the construction machine 1, which consists of the drive engine 6, which is capable of being coupled with a drum drive 10 via a coupling 7, with the said drum drive 10 driving the milling drum 12, which is supported in the machine frame 4, by means of a belt drive 11. It is understood that the coupling 7 may also be arranged on the output side in relation to the drum drive 10.

It is understood that, although the embodiments show a road milling machine as a front-loader, other construction machines with a milling drum 12 like, for instance, rear-loaders or recyclers, can operate in accordance with the same principle.

The monitoring device 14 enables an efficient and safe operation of the construction machine 1 so that it is no longer required to repeatedly reduce the drive engine 6 to idle speed and subsequently increase the operating speed again at the ends of a length of ground to be worked.

What is claimed is:

1. Automotive construction machine (1) for working ground surfaces (2), with a machine frame (4), with a drive engine (6) for driving traveling devices (8) and for driving working devices, and with a milling drum (12) for milling the ground surfaces (2), which is capable of being raised and is driven by and capable of being uncoupled from the drive engine (6), where the milling drum (12) is capable of being moved into a raised position when it is not in milling mode, characterized in that, the milling drum (12) remains coupled with the drive engine (6) when in raised position and with a direction of travel in which the rotating direction of the milling drum (12) corresponds to the rotating direction of the traveling devices (8), and a monitoring device (14) monitors a distance between the milling drum (12) and the ground surface (2) and uncouples the raised milling drum (12) from the drive engine (6) and/or uncouples the traveling devices (8) from the drive engine (6) and/or raises the machine frame (4) and/or generates an alarm signal when the monitoring device (14) detects a deviation that falls below a pre-determined distance.

2. Construction machine (1) in accordance with claim 1, characterized in that the milling drum (12) mills the ground surface (2) in up-milling mode, and in that the milling drum (12) is capable of being moved into a raised position for the purpose of traveling in backward direction, in which the milling drum (12) remains coupled with the drive engine (6).

3. Construction machine (1) in accordance with claim 1, characterized in that the milling drum (12) mills the ground surface (2) in down-milling mode, and in that the milling drum (12) is capable of being moved into a raised position for the purpose of traveling in forward direction, in which the milling drum (12) remains coupled with the drive engine (6).

4. Construction machine (1) in accordance with claim 1, characterized in that the monitoring device (14) monitors, with at least one sensor, a pre-determined distance between the raised milling drum (12) and the ground surface (2).

5. Construction machine (1) in accordance with claim 1, characterized in that the pre-determined distance to be monitored by the monitoring device (14) is capable of being increased in accordance with the travel speed of the traveling devices (8).

6. Construction machine (1) in accordance with claim 1, characterized in that the milling drum (12) is raised by a pre-determined amount that is larger than a minimum distance between the milling drum (12) and the ground surface (2), and in that a sensing device measuring towards the ground surface (2) shows a lower limit position that corresponds to a pre-determined distance or to a minimum distance to be maintained between the milling drum (12) and the ground surface (2).

7. Construction machine (1) in accordance with claim 1, characterized in that at least one sensing device capable of being lowered relative to the raised milling drum (12) is arranged at the milling drum (12) in such a manner that the sensing device projects vis-à-vis the milling drum (12) towards the ground surface (2) by a pre-determined distance, and in that the monitoring device (14), in the raised position of the milling drum (12) and the simultaneously lowered position of the sensing device, uncouples at least the milling drum (12) from the drum drive (10) when the monitoring device (14) detects a contact of the at least one sensing device with the ground surface (2) or that the at least one sensing device is raised by the ground surface (2).

8. Construction machine (1) in accordance with claim 6, characterized in that the sensing device consists of a scraper blade (22) that is arranged behind the milling drum (12) when seen in the direction of travel.

9. Construction machine (1) in accordance with claim 6, characterized in that the sensing device consists of a hood (18) enclosing the milling drum (12) and/or of a side plate (24) arranged at the side next to a front end of the milling drum (12).

10. Construction machine (1) in accordance with claim 1, characterized in that the traveling devices (8) show lifting columns (20) by means of which the machine frame (4) is capable of being raised together with the milling drum (12), and in that the monitoring device (14) generates an input signal for the position of the lifting columns in accordance with the distance monitored and/or the travel speed.

11. Method for working ground surfaces (2) with a construction machine (1) that is automotive by means of traveling devices (8) and in which a milling drum (12) supported in a machine frame (4) is driven by a drive engine (6), where the milling drum (12) is moved into a raised position when it is not in milling mode, characterized in that, the milling drum (12) remains coupled with the drive engine (6) when in raised position and with a direction of travel in which the rotating direction of the milling drum (12) corresponds to the rotating direction of the traveling devices (8), in that a distance is monitored between the rotating, raised milling drum (12) and the ground surface (2) or an obstacle located in front of the milling (12) when seen in the direction of travel, and in that the milling drum (12) is uncoupled from the drive engine (6), and/or the traveling devices (8) are uncoupled from the drive engine (6) and/or the machine frame (4) is raised and/or an alarm signal is generated when detecting that the deviation falls below a pre-determined distance between the milling drum (12) and the ground surface (2).

12. Method in accordance with claim 11, characterized in that the ground surface (2) is milled in up-milling mode, and in that the milling drum (12) is moved into a raised position for the purpose of traveling backwards, in which the milling drum (12) remains coupled with the drive engine (6).

13. Method in accordance with claim 11, characterized in that the ground surface (2) is milled in down-milling mode, and in that the milling drum (12) is moved into a raised position for the purpose of traveling forward, in which the milling drum (12) remains coupled with the drive engine (6).

14. Method in accordance claim 11, characterized in that the pre-determined distance to be monitored is increased in accordance with the increasing travel speed of the traveling devices (8), preferably in a proportional manner.

15. Method in accordance with claim 11, characterized in that the milling drum (12) is raised by a pre-determined amount that is larger than a minimum distance between the milling drum (12) and the ground surface (2), and in that a sensing device measuring towards the ground surface (2) takes a lower limit position which corresponds to a pre-determined distance or to a minimum distance to be maintained between the milling drum (12) and the ground surface (2).

16. Method in accordance with claim 11, characterized in that at least one sensing device at the milling drum (12) is used for monitoring the distance, the said sensing device being lowered relative to the raised milling drum (12) but without touching the ground surface, and in that, as a result of monitoring in the raised position of the milling drum (12) and the simultaneously lowered position of the sensing device, at least the milling drum (12) is uncoupled from the drive engine (6) when detecting a contact of the at least one lowered sensing device with the ground surface (2) or that the at least one sensing device is raised by the ground surface (2).

17. Method in accordance with claim 15, characterized in that a scraper blade (22) that is arranged behind the milling drum (12) when seen in the direction of travel is used as a sensing device.

18. Method in accordance with claim 15, characterized in that a side plate (24) arranged at the side next to the milling drum (12) and/or a hood (18) enclosing the milling drum (12) is used as a sensing device.

19. Method in accordance with claim 11, characterized in that lifting columns (20) are used for raising the milling drum (12) together with the machine frame (4), and in that an input signal for the position of the lifting columns is generated in accordance with monitoring the distance and/or the travel speed.

20. Method in accordance with claim 11, characterized in that lifting columns (20) are used for raising the milling drum (12) together with the machine frame (4), and in that a position signal of the lifting columns (20) is used as distance signal to be monitored for the distance between the milling drum (12) and the ground surface (2).

* * * * *